US006292650B1

(12) United States Patent
Akiyama

(10) Patent No.: US 6,292,650 B1
(45) Date of Patent: Sep. 18, 2001

(54) IMAGE FORMING APPARATUS

(75) Inventor: Kouichi Akiyama, Kawasaki (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,369

(22) Filed: Feb. 18, 2000

(51) Int. Cl.[7] ..... G03G 15/00
(52) U.S. Cl. ..... 399/401; 399/406
(58) Field of Search ..... 399/401, 406; 271/161, 188, 209, 250, 252, 228, 268

(56) References Cited

U.S. PATENT DOCUMENTS

| | | | | |
|---|---|---|---|---|
| 1,685,873 | * | 10/1928 | Evans et al. | 271/188 |
| 3,954,261 | * | 5/1976 | Greene et al. | 271/188 |
| 4,806,979 | * | 2/1989 | Tokoro et al. | 399/401 |
| 4,809,968 | * | 3/1989 | Malachowski | 271/188 X |
| 5,153,663 | * | 10/1992 | Bober et al. | 271/188 X |
| 5,162,857 | * | 11/1992 | Higeta et al. | 399/401 |
| 5,209,466 | * | 5/1993 | Watts et al. | 271/188 |
| 5,515,152 | * | 5/1996 | Kuo | 399/406 |
| 5,724,642 | * | 3/1998 | Cala | 399/406 X |
| 6,032,945 | * | 3/2000 | Miura | 271/188 X |
| 6,094,561 | * | 7/2000 | Ushio | 399/401 |

FOREIGN PATENT DOCUMENTS 5-24746 2/1993 (JP) .

* cited by examiner

*Primary Examiner*—Susan S. Y. Lee
(74) *Attorney, Agent, or Firm*—Foley & Lardner

(57) ABSTRACT

An image forming apparatus is disclosed featuring a transfer portion arranged in an apparatus main body for transferring an image onto a paper sheet, a discharge roller pair for discharging the paper sheet from the apparatus main body when a single-sided image is formed or taking the paper sheet back into the apparatus main body when a two-sided image is formed, a re-transfer portion for re-transferring the paper sheet towards the transfer portion while keeping it in an inverted state, and a stretching portion for removing corrugation of the paper sheet by stretching it as it is transferred by the re-transfer portion.

1 Claim, 3 Drawing Sheets

IMAGE FORMING APPARATUS

BACKGROUND OF THE INVENTION

The present invention relates to an image forming apparatus used as an electrophotographic copying machine.

A paper sheet is usually discharged from a copying machine main body onto a discharge-paper tray projecting from the copying machine main body. In recent years, however, to save space, an intra paper-discharge type of copying machine having the paper-discharge tray within the main body, has been in the mainstream.

Another type of the copying machine is known which has an automatic inverting unit for attaining two-sided copy. The automatic inverting unit is arranged within a main body in the copying machine in which a paper discharge tray projects therefrom, whereas it is attached to an outer side surface portion of the copying machine main body in the intra-discharge type copying machine.

When the two-sided copy is made, the paper sheet on the upper surface side of which an image is copied in an image transfer section, is fed into the automatic inverting unit. The paper sheet is then inverted by the automatic inverting unit and again fed into the image transfer section to transfer an image onto the rear surface side of the paper.

In some copying machines of the intra-discharge type, the paper sheets having an image on the upper surface side are discharged outside from a paper-discharge roller pair in a predetermined amount, and thereafter, taken into the copying machine and sent into the automatic inverting unit by rotating the discharge roller pair in a reverse direction, whereby a two-sided copy can be made.

The paper-discharge roller pair plays a role in corrugating the paper sheet when the paper sheet is discharged through the paper-discharge roller pair. As a result, the paper sheet discharged onto the paper-discharge section acquires structural strength and improved in alignment.

However, when the corrugated paper sheet is returned again to the copying machine main body and fed to the automatic inverting unit to make a rear-side copy, if the paper is corrugated strongly in order to improve the alignment properties of the discharged paper sheet, the paper sheet comes into collusion with a photosensitive drum, leading to a paper jam. Alternatively, the paper sheet is pressed against the photosensitive drum to produce wrinkle at the time of copying the rear surface thereof.

Therefore, in the conventionally-used machine, the paper sheet is weakly corrugated to prevent occurrence of the paper jam or wrinkle at the time copy is made on the rear surface of the paper sheet. However, when the paper sheet is weakly corrugated, there is a problem in that the alignment of the discharged paper sheet decreases.

BRIEF SUMMARY OF THE INVENTION

An object of the present invention is to provide an image forming apparatus without occurrence of a paper jam and wrinkle even if a medium is strongly corrugated by a discharging means.

According to the present invention, there is provided an image forming apparatus comprising:

transfer means arranged in an apparatus main body, for transferring an image onto a medium;

discharging means for transferring the medium having the image transferred by the transfer means on one side thereof to corrugate the medium and discharging the medium as it is from the apparatus main body at the time a single-sided image is formed or taking the medium into the apparatus main body instead of discharging the medium at the time a two-sided image is formed;

re-transfer means for re-transferring the medium taken into the apparatus main body by the discharging means towards the transfer means while keeping an inverted state; and stretching means for stretching the medium transferred by the re-transfer means in a direction of canceling the corrugation.

An image forming apparatus according to the present invention comprises:

transfer means arranged in an apparatus main body, for transferring an image onto a medium;

discharging means for transferring the medium having the image transferred by the transfer means on one side thereof to corrugate the medium and discharging the medium as it is from the apparatus main body at the time a single-sided image is formed or taking the medium into the apparatus main body instead of discharging the medium at the time a two-sided image is formed;

re-transfer means for re-transferring the medium taken into the apparatus main body by the discharging means towards the transfer means while keeping an inverted state; and stretching means for stretching the medium transferred by the re-transfer means in a direction of canceling the corrugation.

wherein the re-transferring means has a transfer roller pair arranged at a predetermined interval in a direction perpendicular to a transfer direction of the medium, and the stretching means is constituted by arranging one of the transfer roller pair so as to incline to a direction perpendicular to the transfer direction of the medium.

An image forming apparatus according to the present invention comprises:

transfer means arranged in an apparatus main body, for transferring an image onto a medium;

discharging means for transferring the medium having the image transferred by the transfer means on one side thereof to corrugate the medium and discharging the medium as it is from the apparatus main body at the time a single-sided image is formed or taking the medium into the apparatus main body instead of discharging the medium at the time a two-sided image is formed;

re-transfer means for re-transferring the medium taken into the apparatus main body by the discharging means towards the transfer means while keeping an inverted state; and stretching means for stretching the medium transferred by the re-transfer means in a direction of canceling the corrugation.

wherein the re-transfer means has a transfer roller pair which are arranged along a direction perpendicular to a transfer direction of the medium, for transferring the medium by holding an entire width of the medium; and the stretch means is constituted by gradually increasing an diameter of one of the transfer roller pair from a center thereof towards right and left edges.

DETAILED DESCRIPTION OF THE INVENTION

Figure 1:
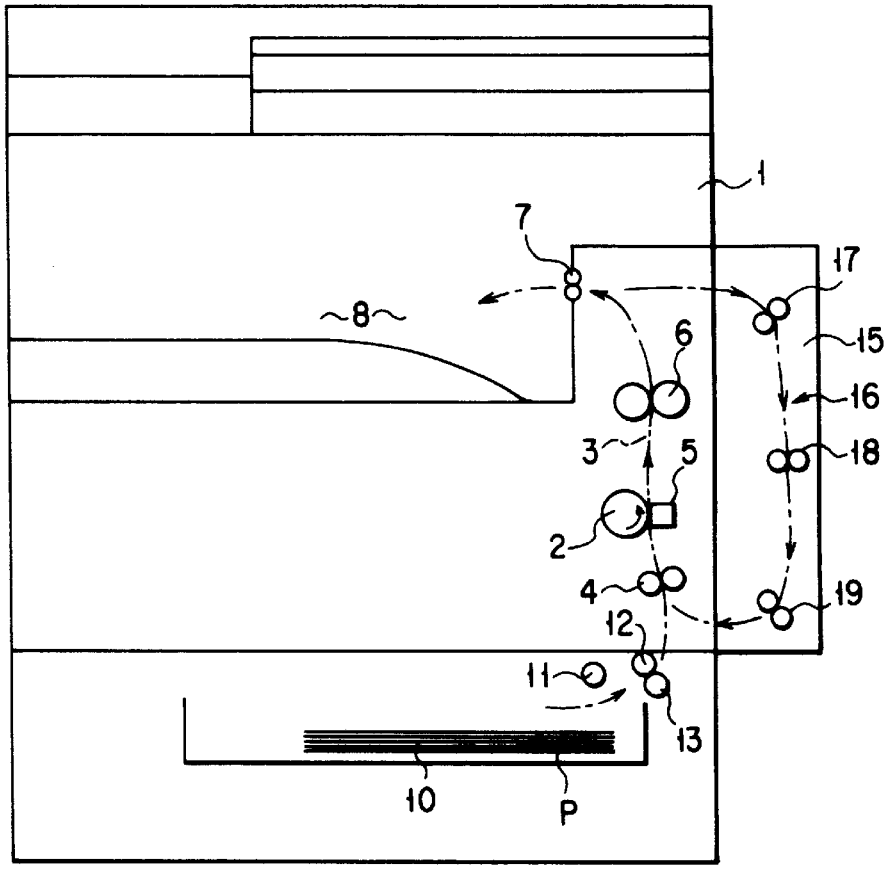
FIG. 1 is a schematic view showing a structure of a copying machine according to an embodiment of the present invention.

Now, the present invention will be explained with reference to embodiments shown in the drawings.

FIG. 1 shows a copying machine of an intra discharge type according to an embodiment of the present invention.

In the figure, reference numeral 1 indicates a main body of the copying machine. A photosensitive drum 2 is rotatably arranged at one side portion of the main body 1. On the photosensitive drum 2, a toner image corresponding to an image of an original document is formed by an image forming mechanism (not shown). The toner image is transferred to a paper sheet as a medium, by a transfer unit 8.

Furthermore, at the one portion of the main body 1, a transfer path 3 for transferring a paper sheet is arranged in a vertical direction. Along the transfer path 3, an alignment roller pair 4, the photosensitive drum 2 described above, and a fixing unit 5 as well as a fixing roller 6 and a discharge roller pair 7 are arranged in the order mentioned from the lower side to the upper side.

The alignment roller pair 4 are used for aligning a paper sheet. The fixing roller 6 is used for fixing a transferred toner image onto the paper sheet. The discharge roller pair 7 is used for discharging the paper sheet. The discharge roller pair 7 is responsi- ble for corrugating the paper sheet at the time the paper sheet is discharged. Since the corrugated paper sheet acquires structural strength, the paper sheet to be discharged to the paper discharge section 8 increases in alignment.

At the lower side portion of the main body 1, a paper-feeding cassette 10 is placed for storing paper sheets P. The paper feeding cassette 10 has a pick-up roller 11 for picking up a paper sheet at one side of the upper portion. Furthermore, a paper-feeding roller 12 and a paper separating roller 13 are provided for separating the papers P picked up one by one and feeding the separated sheet.

Figure 2:
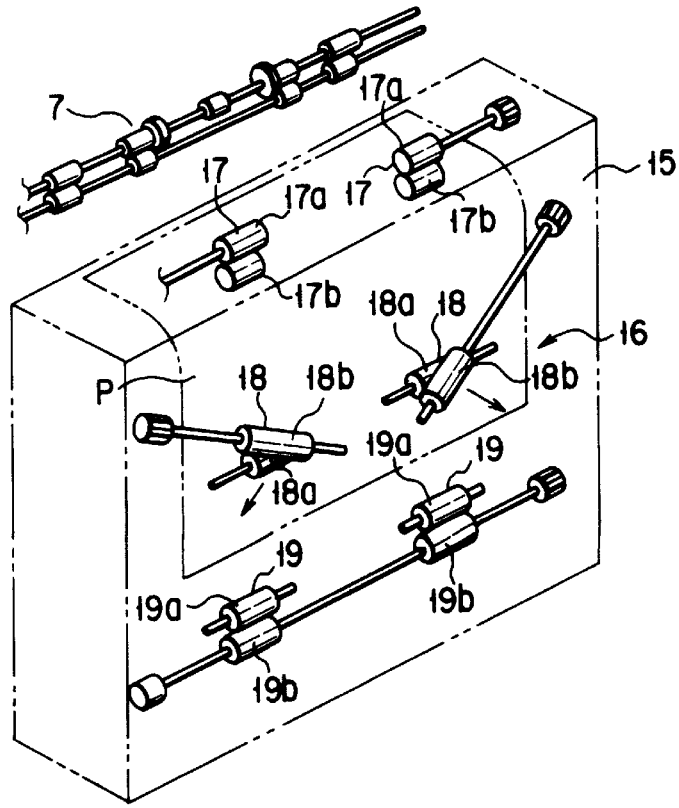
FIG. 2 is a perspective view showing an automatic inverting unit.

On the other hand, an automatic inverting unit 15 is arranged at the one side surface of the main body 1. The structure of the automatic inverting unit 15 is also shown in FIG. 2. In the automatic inverting unit 15, a transfer system 16 is provided for transferring the paper sheet P downwardly from the upper portion. The transfer system 16 is constituted of transfer roller pairs 17/17, 18/18 and 19/19 placed in the upper stage, middle stage and lower stage, respectively. The transfer roller pairs 17/17, 18/18 and 19/19 are bilaterally symmetrically arranged.

The bilaterally arranged transfer roller pairs 17/17 and 19/19 of the upper and lower stages are constituted of a pair of horizontal roller portions 17*a*/17*b* and 19*a*/19*b*, respectively. Each of the bilaterally arranged transfer roller pair 18/18 is consisting of a horizontal roller portion 18*a* and an inclined roller portion 18*b* which is rotatably in contact with the horizontal roller portion 18*a*. The bilaterally arranged inclined roller portions 18*b*, 18*b* are inclined downwardly towards the center portion of the transfer system 16 and thus constructs a paper-stretching means. The paper sheet P is transferred while receiving force towards both right and left sides due to the rotation of the inclined roller portions 18*b*/18*b* bilaterally arranged.

Note that the angle of inclination of the bilaterally arranged roller portions 18*b*/18*b* is determined by the degree of corrugation, the transfer speed of the paper sheet P, the positions and sizes of the transfer roller pairs 17, 18, 19 of the automatic inverting unit 15.

In this embodiment, when the paper sheet P is corrugated with 2 mm/13.5 degrees by the discharge roller pair 7 at a position near 45 mm from the center thereof, the angle of the inclined roller portions 18*b*, 18*b* is set at about 2 degrees.

Figure 3:
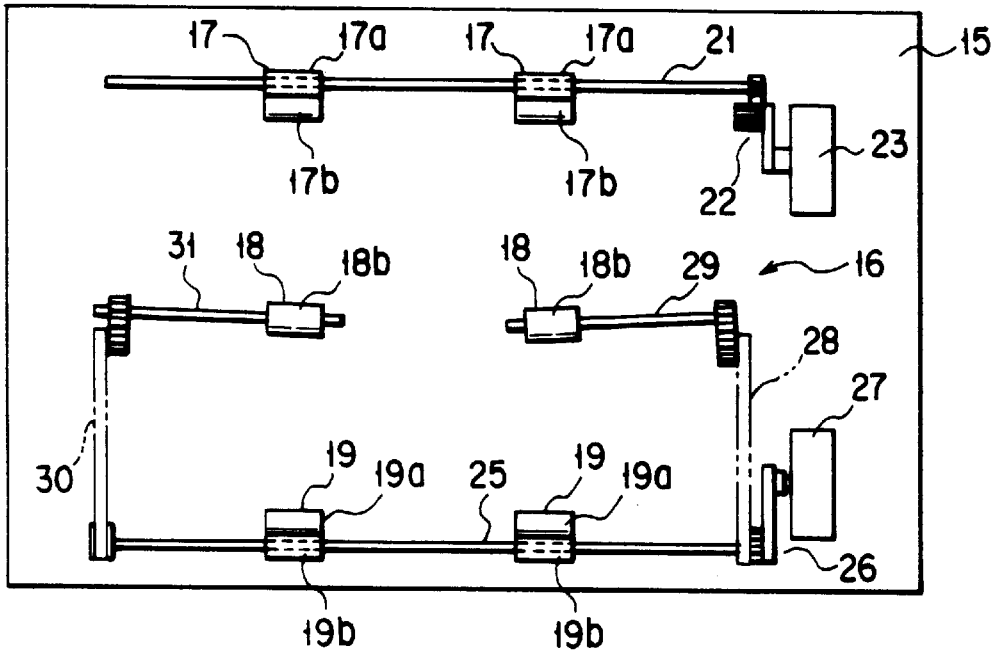
FIG. 3 is a front view of a drive unit of the automatic inverting unit.

FIG. 3 shows a driving mechanism of the transfer system 16 of the automatic inverting unit.

The bilaterally arranged horizontal roller portions 17*a*, 17*a* of the upper stage are fitted to a shaft 21. To one end of the shaft 21, a first driving motor 23 is connected via a power transmission system 22 consisting of a gear or a belt.

The bilaterally arranged horizontal rollers 19*a*, 19*a* of the lower stage are fitted to the shaft 25. To one end of the shaft 25, a second driving motor 27 is connected via a power transmission system 26 consisting of a gear or a belt.

Furthermore, to the end of the shaft 25, an end portion of the shaft 29 of the inclined roller portion 18*a* arranged at a right side of the middle stage is connected via a power transmission system 28. To the other end portion of the shaft 25, an end of a shaft 31 of the inclined roller portion 18*a* arranged at the left side of the middle stage is connected via a power transmission system 30 consisting of a gear and a belt.

When the first driving motor 23 is driven, the transfer roller pair 17, 17 of the upper stage are rotated via the shaft 21. When the second driving motor 27 is driven, the transfer roller pair 19, 19 of the lower stage are rotated via the shaft 25 and simultaneously the transfer roller pair 18, 18 of the middle stage are rotated via the shafts 29, 31.

Now, how to form an image will be explained.

A toner image corresponding to an image of an original document is formed by the image forming mechanism (not shown) on the photosensitive drum 2. On the other hand, at the time the image is formed, a paper sheet P is taken out from the paper-feeding cassette 10 by the pick-up roller 11 and fed to the transfer path 3 by means of the paper-feeding roller 12 and the separation roller 13. The leading edge of the paper sheet P is aligned by the alignment roller pair 4 and thereafter fed to the image transfer section between the photosensitive drum 2 and the transfer unit 5. At the image transfer section, a toner image on the photosensitive drum 2 is transferred to the upper surface side of the paper sheet P. The paper sheet P having the toner image transferred thereon is removed from the photosensitive drum 2 and transferred to the fixing roller 6, by which a transfer image is fixed on the paper sheet P. The paper sheet P having the image fixed thereon is discharged to the paper-discharge section 8 via the discharge roller pair 7 at the time a single-sided copy is made. In the two-sided copy, when the paper sheets discharged from the paper discharge roller pair 7 reach a predetermined amount, the discharging operation of the paper sheets is terminated. Thereafter, the paper sheets P are taken into the main body by rotating the paper-discharge roller pair 7, reversely. The paper sheet P taken-in is fed into the automatic inverting unit 15.

The paper sheet P fed into the automatic inverting unit 15 is sandwiched and transferred by the bilater-ally arranged transfer roller pair 17, 17 of the upper stage and fed to the copying machine main body 1 by way of the bilaterally arranged transfer roller pair 18, 18 of the middle stage and the bilaterally arranged transfer roller pair 19, 19 of the lower stage. The paper sheet P thus fed is transferred again to the image transfer section while keeping an inverted state.

In the image transfer section, an toner image is transferred to a rear surface side of the paper sheet P. After completion of the transfer, the paper sheet P is removed from the photosensitive drum 2 and fed to a fixing drum 6. In the fixing drum 6, a transfer image is fixed onto the paper sheet P. After the fixing, the paper sheet P is discharged to the paper-discharge section through the discharge roller pair 7.

In the two-sided copy, by the time when the paper sheets are discharged from the discharge roller pair 7 in a predetermined amount, the paper sheets P have been corrugated by the discharge roller pair 7 to have structural strength. The corrugated paper sheet is transferred to the image transfer section through the automatic inverting unit 15 as it is. In this case, if the paper sheet is strongly corrugated, the paper sheet P will collide with the photosensitive drum 2, leading to the occurrence of a paper jam or wrinkle.

However, in the present invention, since each of the bilaterally arranged transfer roller pair 18, 18 of the middle stage of the transfer system 16 of the automatic inverting unit 15 is constituted of the inclined roller portions 18*b*, 18*b*, the paper sheet P receives force stretching toward the right and left sides while it passes through the bilaterally arranged inclined roller portions 18*b*, 18*b*. As a result, the corrugation imparted to the paper sheet P is weakened. Therefore, even though the paper sheet P is fed again to the image transfer section, the occurrence of the jam and wrinkle can be avoided.

As described in the foregoing, unlike a conventional case, the paper sheet P is not necessary to be corrugated weakly, in other words, the paper sheet P can be strongly corrugated by the paper-discharge roller pair 7. As a result, alignment of the paper sheet P in the paper discharge section 8 can be improved.

Figure 4:
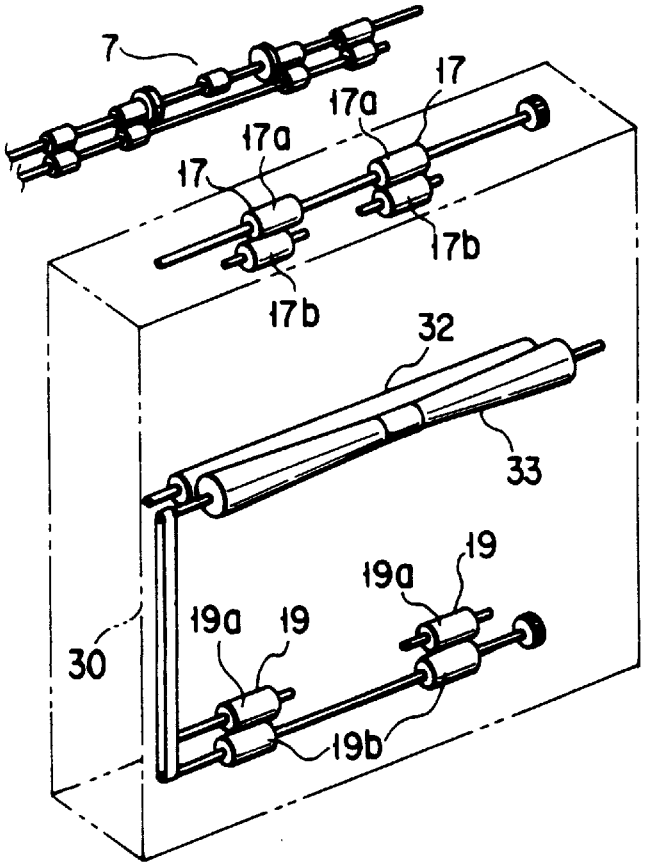
FIG. 4 is a perspective view of another automatic inverting unit.

FIG. 4 shows an automatic inverting unit according to a second embodiment of the present invention.

Like reference numerals are used to designate like structural elements corresponding to those in the first embodiment and any further explanation is omitted for brevity's sake.

In the second embodiment, a transfer roller pair 31 of the middle stage of the transfer system 16 of the automatic inverting unit is constituted of a single long first transfer roller portion 32 and a single long second transfer roller portion 33 rotatably in contact with the first transfer roller portion 32.

Figure 5:
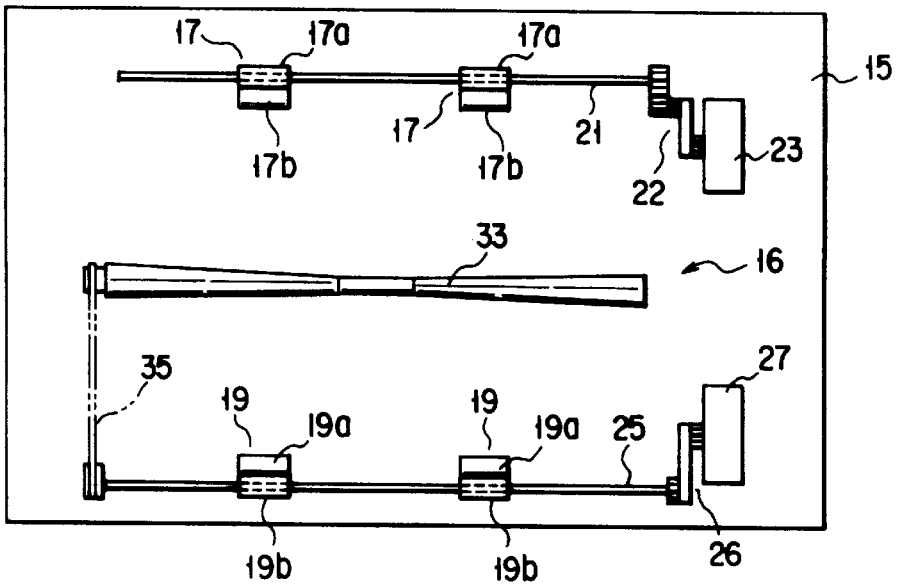
FIG. 5 is a front view of a drive unit of another automatic inverting unit.

FIG. 5 shows a driving mechanism of the transfer system 16. The second transfer roller portion 33 is connected to one end of the shaft 25 of the transfer roller pair 19, 19 of the lower stage via a power transmission system 35 consisting of a gear or a belt.

Figure 6:
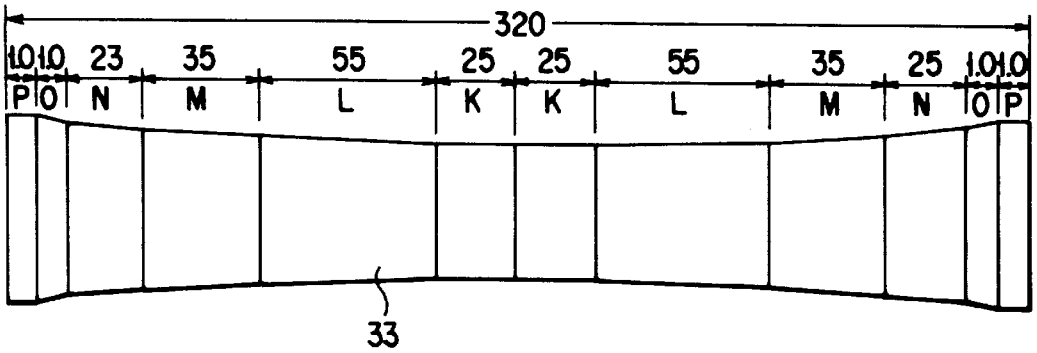
FIG. 6 is a front view of a transfer roller for canceling the corrugation.

FIG. 6 is a magnified view of the second transfer roller portion 33.

The second transfer roller portion 33 has a crown form and gradually increases in roller diameter from the center portion toward the right and left edges as shown in the following table.

| Region | Taper (mm) |
|---|---|
| K | Parallel portion |
| L | 0.025/55 |
| M | 0.050/35 |
| N | 0.055/25 |

-continued

| Region | Taper (mm) |
|---|---|
| o | 0.050/10 |
| P | Parallel portion |

The first and second transfer roller portions 32, 33 have lengths larger than the paper width of A3/A4-R size and are used in stretching the transferred paper sheet P in a direction of broadening it to thereby weaken corrugation.

In this embodiment, the paper sheet P can be corrugated strongly by the paper-discharge roller pair 7 in the same manner as in the aforementioned first embodiment. As a result, the alignment of the paper sheet P in the paper discharge section 8 can be improved.

According to the present invention, since the corrugation of the paper sheet P passing though the automatic inverting unit 15 can be weakened, it is therefore possible to prevent the occurrence of the paper jam and wrinkle.

Furthermore, since the paper sheet P can be strongly corrugated by the paper discharge roller pair 7, the alignment of the paper sheet at the paper discharge section 8 can be improved.

Moreover, since the corrugation can be weakened only by changing the transfer roller pair 18 and a part of the transfer roller pair 31 in the automatic inverting unit 15 to the inclined roller portion 18*b* and the transfer roller portion 33 of a crown form, it is therefore possible to render the structure simple by adding few parts without complicating the structure thereof.

What is claimed is:

1. An image forming apparatus comprising:

a transfer portion arranged in an apparatus main body for transferring an image onto a medium;

a discharging portion for transferring the medium having the image transferred by the transfer portion on one side thereof to corrugate the medium and discharging the medium as it is from the apparatus main body at the time a single-sided image is formed or taking the medium into the apparatus main body instead of discharging the medium at the time a two-sided image is formed;

a re-transfer portion for re-transferring the medium taken into the apparatus main body by the discharging portion towards the transfer portion while keeping the medium in an inverted state; and a stretching portion for stretching the medium transferred by the re-transfer portion in a direction so as to cancel the corrugation, wherein the stretching portion comprises a first pair of rollers having a shaft extending along a direction perpendicular to a transfer direction of the medium and arranged in the direction of the shaft at a predetermined interval therebetween, and a second pair of rollers each having a shaft with a centerline, each roller shaft being oriented so that their respective centerlines will diagonally cross with each other at a downstream side of the transfer direction of the medium, wherein the second pair of rollers are placed in contact with the corresponding first pair of rollers, and the first pair of rollers transfer said medium in concert with the second pair of rollers by sandwiching the medium therebetween.

* * * * *